US008748759B2

(12) United States Patent
Howard

(10) Patent No.: US 8,748,759 B2
(45) Date of Patent: Jun. 10, 2014

(54) CIRCUIT BREAKER LOCKOUT

(75) Inventor: David M. Howard, Dawsonville, GA (US)

(73) Assignee: Panduit Corp., Tinley Park, IL (US)

( * ) Notice: Subject to any disclaimer, the term of this patent is extended or adjusted under 35 U.S.C. 154(b) by 121 days.

(21) Appl. No.: 13/569,712

(22) Filed: Aug. 8, 2012

(65) Prior Publication Data

US 2013/0037393 A1 Feb. 14, 2013

Related U.S. Application Data

(60) Provisional application No. 61/522,732, filed on Aug. 12, 2011.

(51) Int. Cl.
*H01H 9/28* (2006.01)

(52) U.S. Cl.
USPC ..... 200/43.14

(58) Field of Classification Search
USPC ..... 200/43.01–43.22, 329–339
See application file for complete search history.

(56) References Cited

U.S. PATENT DOCUMENTS

| | | | | |
|---|---|---|---|---|
| 2,568,103 | A | 9/1951 | Woolf et al. | |
| 2,663,768 | A | 12/1953 | Sorenson | |
| 4,347,412 | A | 8/1982 | Mihara et al. | |
| 4,882,456 | A | 11/1989 | Hovanic et al. | |
| 5,122,624 | A | 6/1992 | Benda | |
| 5,225,963 | A | 7/1993 | Smart | |
| 5,300,740 | A | 4/1994 | Benda | |
| 5,310,969 | A | 5/1994 | Turek et al. | |
| 5,331,122 | A | 7/1994 | Winder | |
| 5,500,495 | A | 3/1996 | Benda et al. | |
| 5,577,599 | A | 11/1996 | Turek et al. | |
| 5,731,560 | A | 3/1998 | Nebon et al. | |
| 5,868,242 | A | 2/1999 | Hall et al. | |
| 6,469,264 | B2 | 10/2002 | Benda | |
| 6,476,698 | B1 | 11/2002 | Anand et al. | |
| 6,617,532 | B1 | 9/2003 | Turek | |
| 6,727,441 | B2 | 4/2004 | Benda | |
| 6,791,040 | B1 * | 9/2004 | Puhalla et al. | 200/43.14 |
| 6,844,512 | B2 | 1/2005 | Benda | |
| D535,629 | S | 1/2007 | Kalous et al. | |
| 7,186,067 | B2 | 3/2007 | Leblanc | |
| 7,262,376 | B2 | 8/2007 | Brojanac et al. | |
| 7,355,132 | B1 * | 4/2008 | Rezac et al. | 200/43.14 |
| 7,371,980 | B2 | 5/2008 | Marshall | |
| 7,442,888 | B2 * | 10/2008 | Puddicombe et al. | 200/43.04 |

(Continued)

FOREIGN PATENT DOCUMENTS

| | | | |
|---|---|---|---|
| CA | 2577167 | A1 | 8/2008 |
| EP | 1944780 | A1 | 7/2008 |

(Continued)

*Primary Examiner* — Edwin A. Leon
(74) *Attorney, Agent, or Firm* — Christopher S. Clancy; Aimee E. McVady

(57) ABSTRACT

The present invention is directed to a circuit breaker lockout device installed on a circuit breaker switch. The circuit breaker lockout device includes a first body section and a second body section. A handle extends through the first body section and the second body section. The handle includes a lockout screw with a screw head having a plurality of slots and a handle pin for engaging one of the plurality of slots. The lockout screw is turned by the handle to control the movement of the first body section and the second body section with respect to each other to engage the circuit breaker switch.

10 Claims, 10 Drawing Sheets

(56) References Cited

U.S. PATENT DOCUMENTS

| | | | | |
|---|---|---|---|---|
| 7,501,593 | B2 | 3/2009 | Brojanac | |
| 7,531,760 | B1 * | 5/2009 | Whipple et al. | 200/43.19 |
| 2004/0245077 | A1 | 12/2004 | Benda | |
| 2008/0277249 | A1 | 11/2008 | Zubieta et al. | |

FOREIGN PATENT DOCUMENTS

| | | | |
|---|---|---|---|
| GB | 1451954 | | 10/1976 |
| WO | 02077901 | A2 | 10/2002 |
| WO | 03041102 | A1 | 5/2003 |
| WO | 2006105288 | A2 | 10/2006 |

* cited by examiner

CIRCUIT BREAKER LOCKOUT

CROSS-REFERENCE TO RELATED APPLICATIONS

This application claims priority to U.S. Provisional Application No. 61/522,732, filed Aug. 12, 2011, the subject matter of which is hereby incorporated by reference in its entirety.

FIELD OF THE INVENTION

The present invention relates to a lockout device, and more particularly to a side grip circuit breaker lockout device.

BACKGROUND OF THE INVENTION

Circuit breaker lockout devices generally include multiple pieces that slide together to fit around a switch or lever of a circuit breaker. The lockout devices generally grip the switch or lever to lock the circuit breaker. However, prior lockout devices are difficult to install on the circuit breaker and fail to adequately grip the circuit breaker switch or lever. During installation, the lockout device often damages the switch or lever of the circuit breaker leaving markings on the switch or lever when the lockout device is removed.

Thus, it is desirable to provide a circuit breaker lockout device that is easy to securely install on a circuit breaker without damaging the circuit breaker switch or lever.

SUMMARY OF THE INVENTION

The present invention is directed to a circuit breaker lockout device. The circuit breaker lockout device includes a first body section, a second body section and a handle. The first body section and the second body section are positioned on either side of a circuit breaker switch. The handle extends through the first body section and the second body section. The handle includes a lockout screw with a screw head having a plurality of slots. A handle pin engages one of the plurality of slots. When the handle pin engages a slot, the lockout screw is turned by the handle to control the movement of the first body section and the second body section with respect to each other.

DETAILED DESCRIPTION

FIGS. 1-7 illustrate a single pole circuit breaker 20 and the circuit breaker lockout device 30 of the present invention. As illustrated in FIGS. 2-7, the circuit breaker lockout device 30 grips the sides 24 of the circuit breaker switch 22 to lock the circuit breaker 20 in an "on position" or in an "off position."

Figure 1:
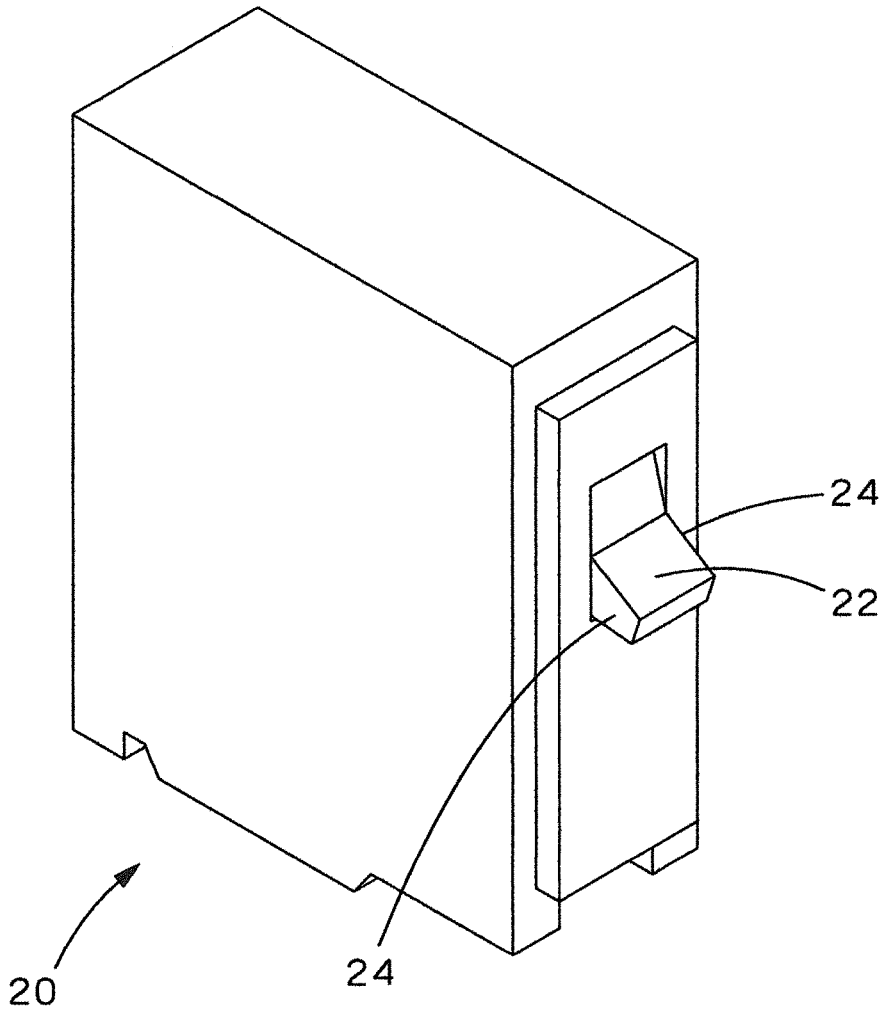
FIG. 1 is a perspective view of a single pole circuit breaker.
Figure 2:
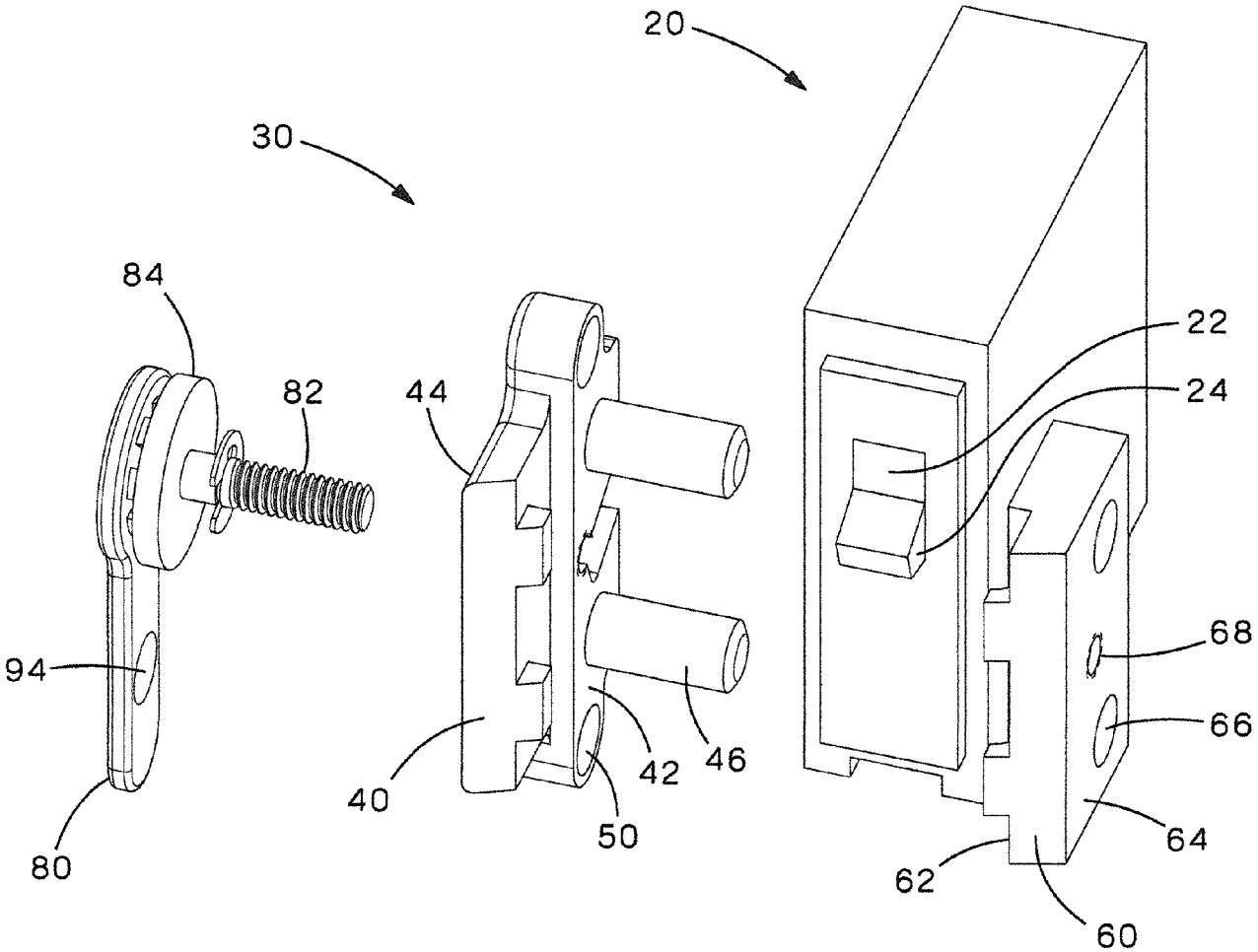
FIG. 2 is a perspective view of the single pole circuit breaker of FIG. 1 with an exploded perspective view of the circuit breaker lockout device of the present invention.

FIG. 2 illustrates the circuit breaker lockout device 30 positioned to be installed on the breaker switch 22 of the single pole circuit breaker 20. The circuit breaker lockout device 30 includes a first body section 40, a second body section 60 and a lockout handle 80. The first body section 40 and the second body section 60 include an inner wall 42, 62 and an outer wall 44, 64, respectively. The first body section 40 also includes lock holes 50 at the top and bottom for receiving a padlock 100 to secure the installed lockout device 30 (see FIG. 6). The inner wall 42 of the first body section 40 includes two outwardly extending pins 46. The inner wall 62 of the second body section 60 includes two pin holes 66 for receiving the outwardly extending pins 46 of the first body section 40. The outwardly extending pins 46 enable the first and second body sections 40, 60 to be positioned on either side 24 of the breaker switch 22 as illustrated in FIG. 2.

Figure 3:
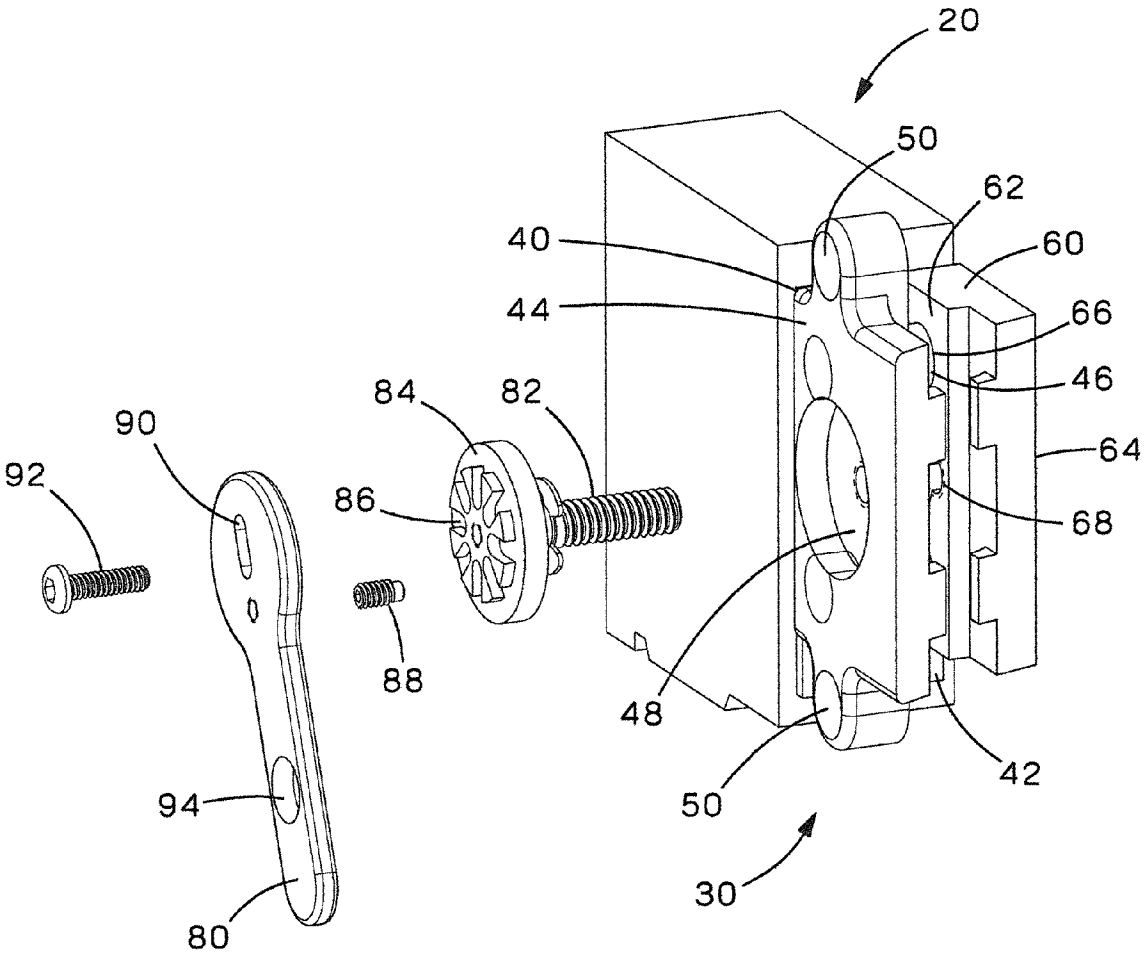
FIG. 3 is a perspective view of the single pole circuit breaker and the circuit breaker lockout device of FIG. 2 with the circuit breaker lockout device partially installed on the circuit breaker.

As illustrated in FIGS. 2 and 3, the lockout handle 80 includes a lockout screw 82 with a lockout screw head 84. The lockout screw head 84 includes a plurality of slots 86. The lockout handle 80 also includes a lockout handle pin 88 that is designed to engage one of the slots 86 on the lockout screw head 84.

As illustrated in FIG. 3, the first body section 40 includes a center cavity 48. The center cavity 48 receives the lockout screw head 84 when the lockout screw 82 is installed in the first body section 40. The second body section 60 includes a threaded screw hole 68 to receive the lockout screw 82 when the lockout screw 82 is installed in the second body section 60.

The distance between the first body section 40 and the second body section 60 is controlled by the lockout screw 82 that is positioned in the first body section 40 and threaded into the second body section 60. The outwardly extending pins 46 allow the first and second body sections 40, 60 to slide closer together or further apart depending on the size of the breaker switch 22. The first and second body sections 40, 60 are held in position relative to each other by the outwardly extending pins 46 disposed in the pin holes 66.

When the circuit breaker lockout device 30 is assembled, the lockout screw 82 is turned via the lockout handle 80 to control the movement of the first and second body sections 40, 60. When the lockout screw 82 is turned via the lockout handle 80 in the clockwise direction, the first and second body sections 40, 60 are brought closer together and when the lockout screw 82 is turned via the lockout handle 80 in the counterclockwise direction, the first and second body sections 40, 60 are brought farther apart.

As illustrated in FIGS. 4-7, the lockout handle 80 also includes a slot 90 that receives a handle cap screw 92. The handle cap screw 92 secures the lockout handle 80 to the lockout screw 82. The slot 90 in the lockout handle 80 allows the lockout handle 80 to slide with respect to the lockout screw 82. As the lockout handle 80 slides, the handle pin 88 can engage (FIGS. 5 and 6) or disengage (FIG. 7) the lockout screw head slots 86. When the handle pin 88 is not engaged in one of the lockout screw head slots 86, the lockout handle 80 will rotate independently of the lockout screw 82.

To install the lockout device 30, the user rotates the lockout handle 80 in the counterclockwise direction as far as possible when the lockout handle pin 88 is disengaged from the lockout screw head slots 86. Next the user slides the lockout handle 80 so that the handle pin 88 engages one of the lockout screw head slots 86 and then rotates the handle 80 in the clockwise direction for one half of a full turn. The user repeats this process until the desired clamping force on the breaker switch 22 is reached.

Figure 4:
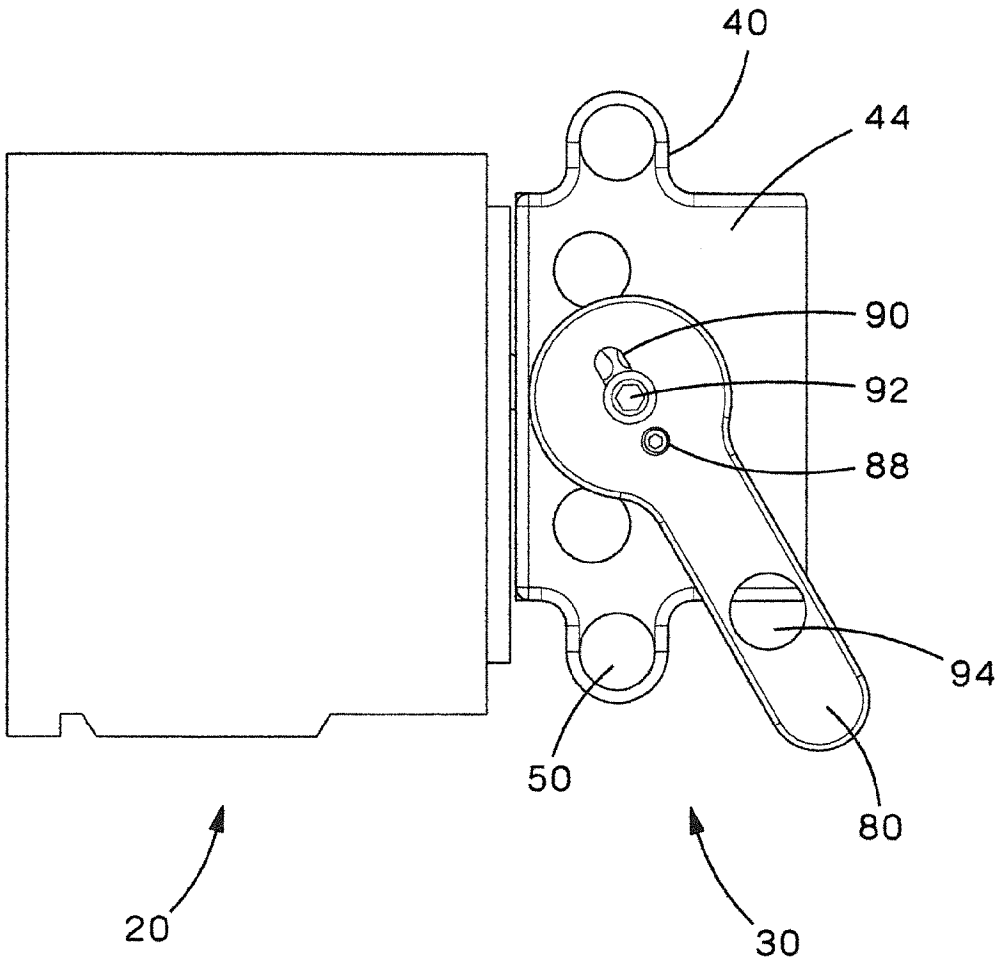
FIG. 4 is a side view of the circuit breaker lockout device installed on the single pole circuit breaker of FIG. 2.
Figure 5:
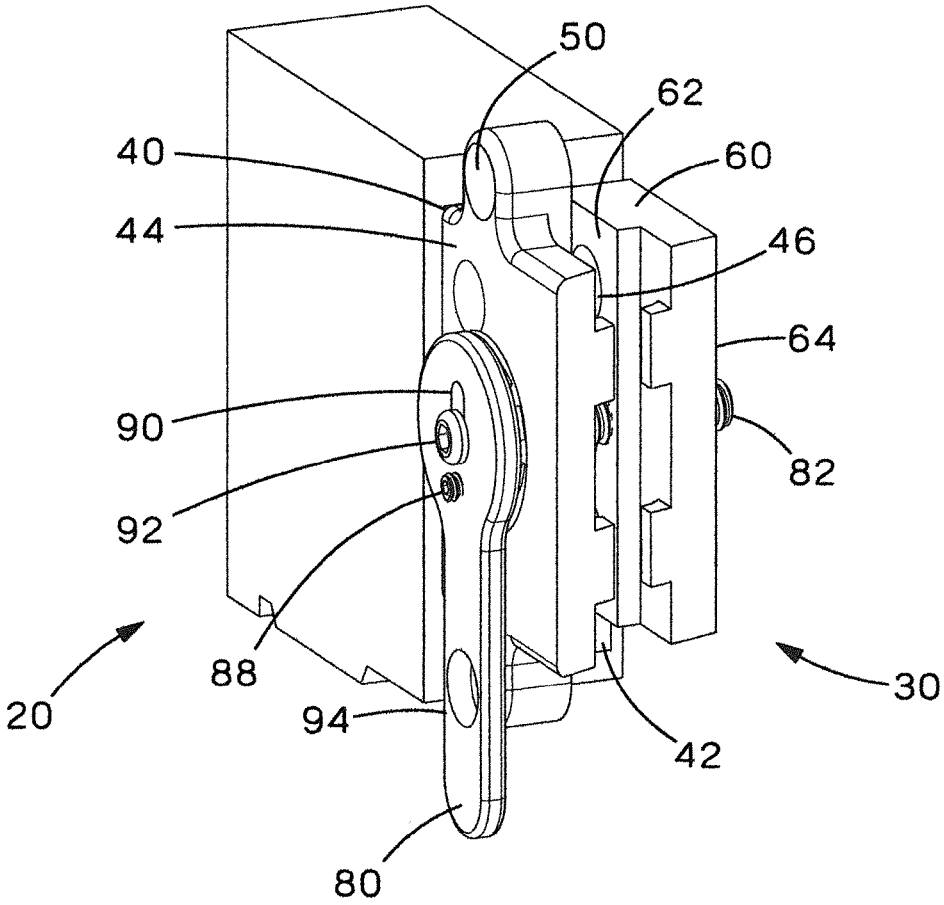
FIG. 5 is a perspective view of the circuit breaker lockout device installed on the single pole circuit breaker of FIG. 4.
Figure 6:
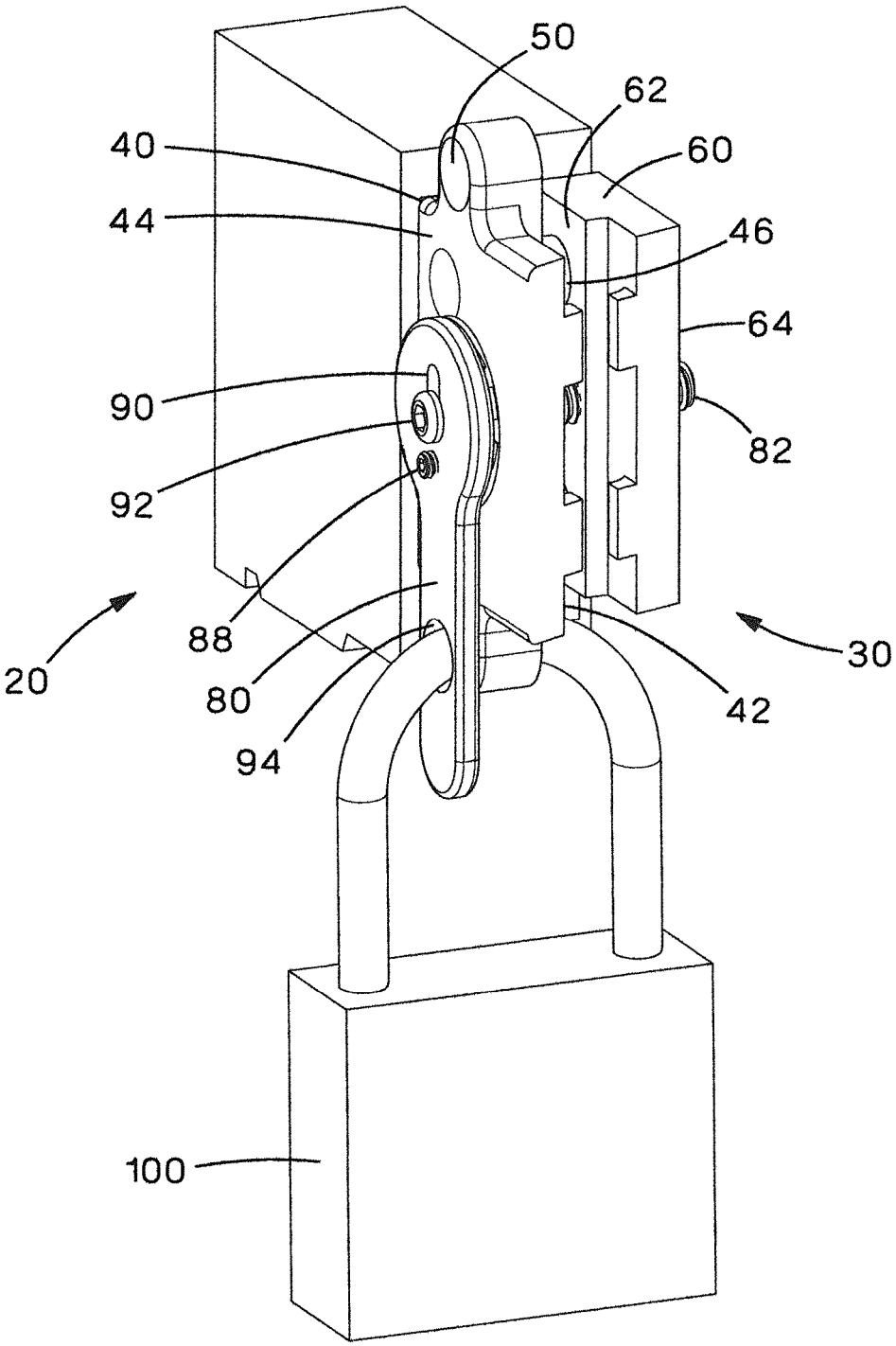
FIG. 6 is a perspective view of the circuit breaker lockout device installed on the single pole circuit breaker of FIG. 5 with a padlock installed on the circuit breaker lockout device.
Figure 7:
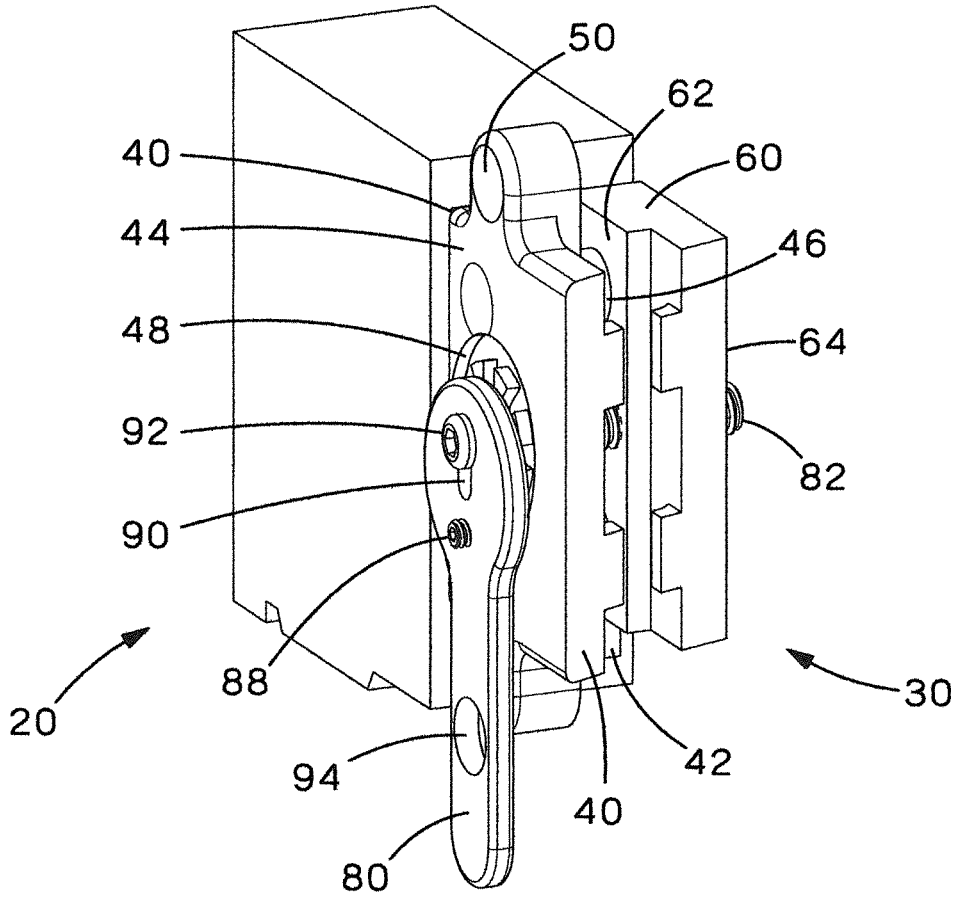
FIG. 7 is a perspective view of the circuit breaker lockout device installed on the single pole circuit breaker of FIG. 5 with the handle pin disengaged.

FIGS. 4-6 also illustrate the lockout handle 80 with a hole 94 for receiving the padlock 100. When the hole 94 in the lockout handle 80 aligns with one of the lock holes 50 in the first body section 40, the padlock 100 may be installed. Once the padlock 100 is installed, the position of the lockout handle 80 is fixed to prevent movement of the lockout device 30 and to prevent removal of the clamp force on the circuit breaker switch 22.

Figure 8:
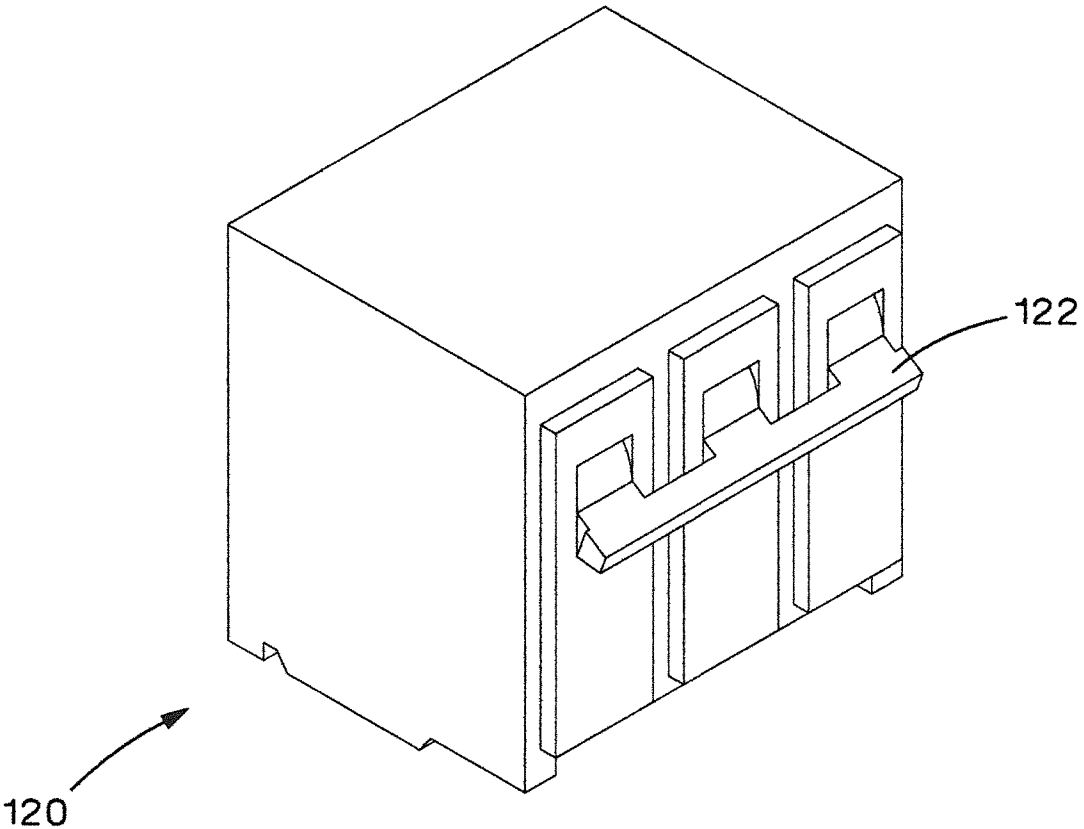
FIG. 8 is a perspective view of a multi-pole circuit breaker.
Figure 9:
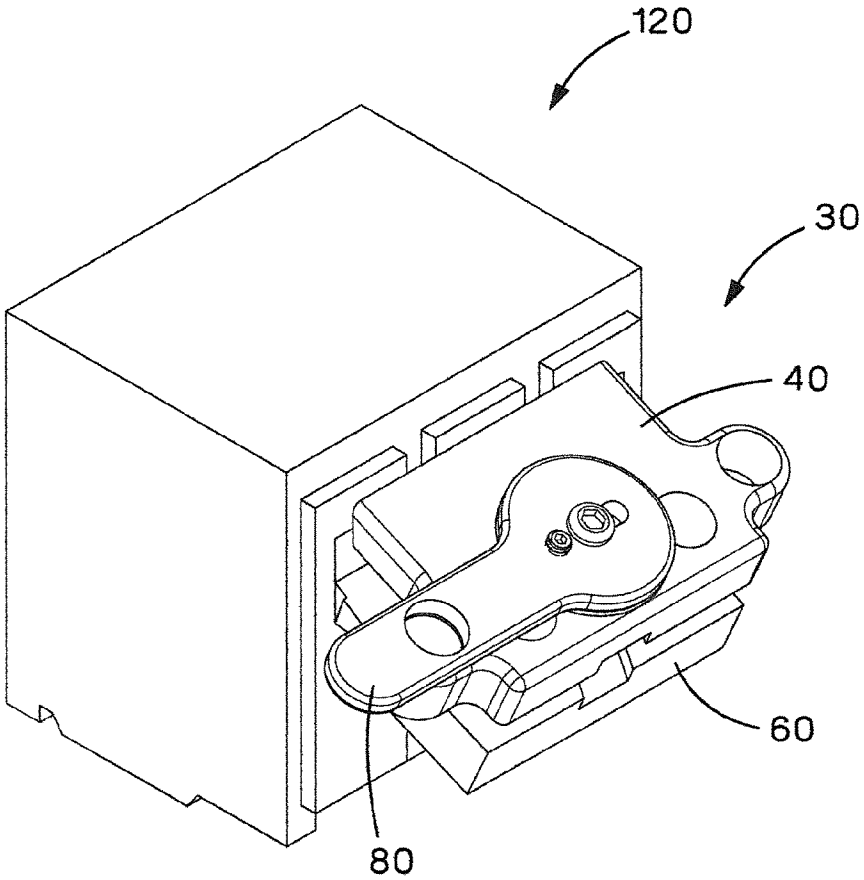
FIG. 9 is a perspective view of the circuit breaker lockout device of the present invention installed on the multi-pole circuit breaker of FIG. 8.
Figure 10:
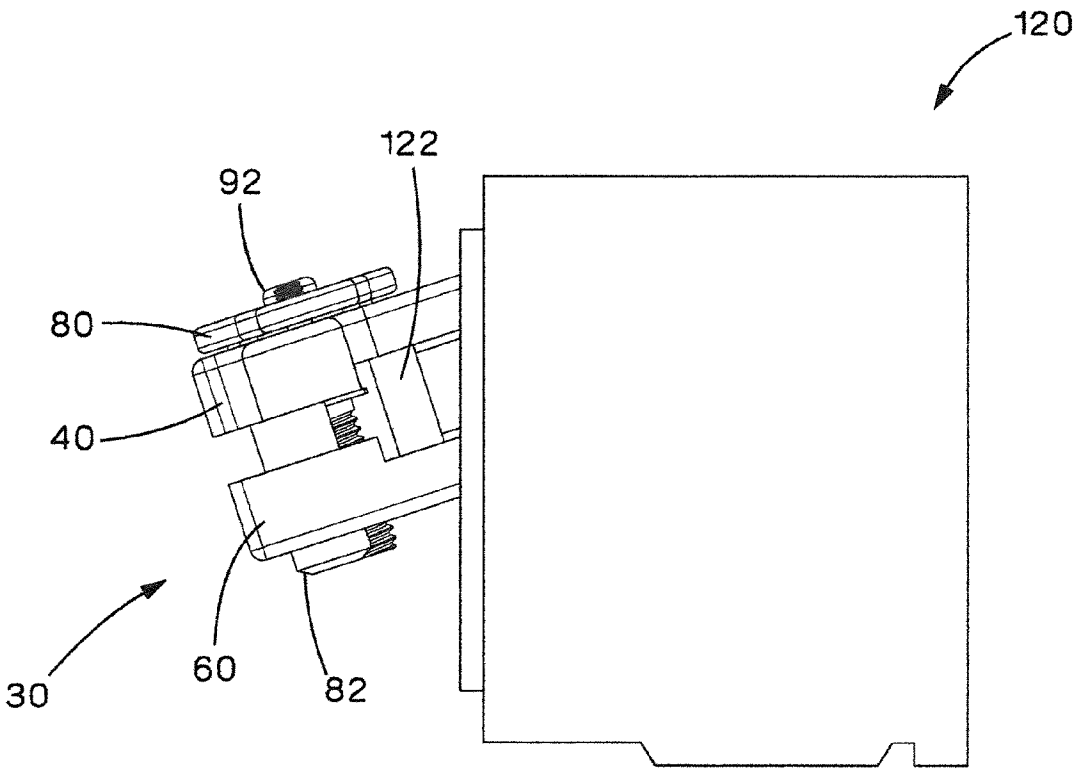
FIG. 10 is a side view of the circuit breaker lockout device and the multi-pole circuit breaker of FIG. 9.

As shown in FIGS. 8-10, the circuit breaker lockout device of the present invention may be used on a multi-pole circuit breaker 120. The jaw end of the lockout device 30 is designed to grip the circuit breaker handle 122. The first and second body sections 40, 60 of the circuit breaker lockout device 30 will prevent movement of the circuit breaker handle 122. The circuit breaker lockout device 30 is installed and removed in the same fashion as described above with respect to the single pole circuit breaker 20.

The side grip circuit breaker lockout device of the present invention provides a high clamp force with no damage to the circuit breaker switch. The circuit breaker lockout device also leaves no evidence of installation on the circuit breaker switch.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation.

The invention claimed is

1. A circuit breaker lockout device comprising:

a first body section having an inner wall and an outer wall;

a second body section engagable with the first body section, the second body section having an inner wall and an outer wall; and a handle extending through the first body section and the second body section, wherein the handle having a lockout screw with a screw head having a plurality of slots and a handle pin for engaging one of the plurality of slots, whereby the lockout screw is turned by the handle to control the movement of the first body section and the second body section with respect to each other.

2. The circuit breaker lockout device of claim 1, wherein the inner wall of the first body section having at least one outwardly extending pin and the inner wall of the second body section having at least one hole for receiving the at least one outwardly extending pin of the first body section.

3. The circuit breaker lockout device of claim 2, wherein the at least one outwardly extending pin disposed in the at least one hole holds the first body section and the second body section together.

4. The circuit breaker lockout device of claim 1, wherein the outer wall of the first body section having a center cavity for housing the screw head of the lockout screw and the second body section having a center hole for receiving the lockout screw.

5. The circuit breaker lockout device of claim 1, wherein the handle further comprising a handle cap screw for securing the handle to the lockout screw.

6. The circuit breaker lockout device of claim 5, wherein the handle further comprising a slot for enabling the handle to slide with respect to the lockout screw.

7. The circuit breaker lockout device of claim 6, wherein the handle cap screw is positioned at a first end of the slot and the handle pin engages at least one of the plurality of screw head slots to enable the handle to turn the lockout screw.

8. The circuit breaker lockout device of claim 6, wherein the handle cap screw is positioned at a second end of the slot and the handle pin disengages at least one of the plurality of screw head slots to enable the handle to rotate independently of the lockout screw.

9. The circuit breaker lockout device of claim 1, wherein the first body section includes at least one hole at a top and a bottom for receiving a padlock to secure the lockout device.

10. The circuit breaker lockout device of claim 9, wherein the handle having a hole, the hole in the handle aligning with the at least one hole in at the top and bottom of the first body section for receiving a padlock to secure the device.

* * * * *